United States Patent [19]

Williams

[11] 4,073,108

[45] Feb. 14, 1978

[54] METHOD AND APPARATUS FOR RIGIDLY INTERCONNECTED CEILING AND WALL CONSTRUCTION

[76] Inventor: Arthur C. Williams, 21711 Glenbranch Drive, Spring, Tex. 77373

[21] Appl. No.: 674,963

[22] Filed: Apr. 8, 1976

Related U.S. Application Data

[63] Continuation-in-part of Ser. No. 464,192, April 25, 1974, abandoned.

[51] Int. Cl.[2] ..... E04H 1/00

[52] U.S. Cl. ..... 52/238; 52/262; 52/714

[58] Field of Search ..... 52/489, 714, 715, 284, 52/262, 481, 370, 369, 241, 238, 758 A, 213, 242; 403/387, 400

[56] References Cited

U.S. PATENT DOCUMENTS

| | | | |
|---|---|---|---|
| 1,777,358 | 10/1930 | Goldsmith | 52/370 |
| 2,191,979 | 2/1940 | Bierbach | 52/370 |
| 2,990,037 | 6/1961 | Fowles | 52/284 X |
| 3,293,819 | 12/1966 | Heirich | 52/489 X |
| 3,589,660 | 6/1971 | Dunckel | 52/39 X |

*Primary Examiner*—Ernest R. Purser
*Assistant Examiner*—Carl D. Friedman
*Attorney, Agent, or Firm*—Bard, Springs, Jackson & Groves

[57] ABSTRACT

In one exemplar embodiment, a construction hanger for rigidly interconnecting ceiling inverted tee support members and a structural wall channel member is provided, the hanger having a generally U-shaped configuration with a body member and extending depending legs spaced to receive the channel member. The legs are bendable to engage the channel member and securely grip and support the member. In one embodiment, a generally U-shaped gripping means is provided for gripping the inverted tee support member having bendable tabs extending from a generally flat base, the tabs spaced to receive the tee support member and bendable over the flanges of the member to grip it securely. The U-shaped gripping means is pivotally attached to the body member of the hanger.

In another embodiment a pre-formed gripping means is provided having opposing spring clamping members, one spring clamping member having edges depending therefrom which engages one flange of the tee support member to prevent movement along the member and a second spring clamping member just long enough to engage the tee support member and having a plurality of teeth to prevent movement after engaging the other flange of the tee support member. A novel wall structure and method of wall construction utilizing the hanger is also disclosed.

19 Claims, 17 Drawing Figures

FIG. 1
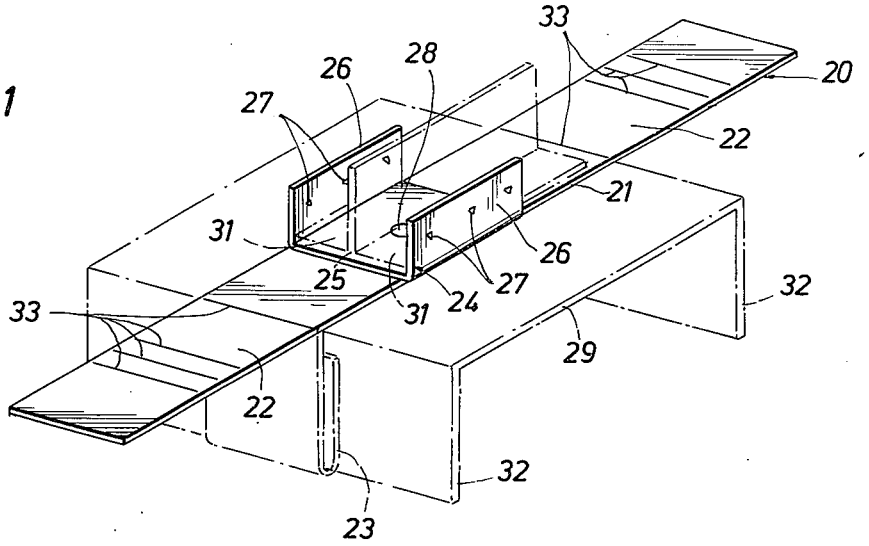
FIG. 13
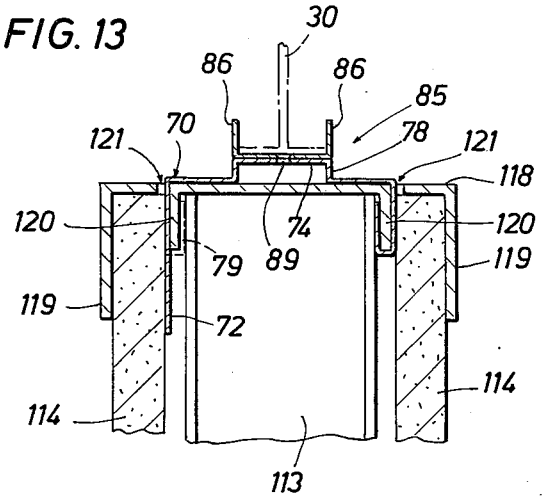
FIG. 14
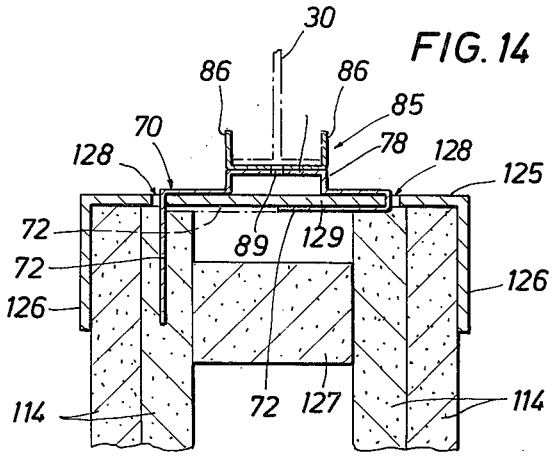
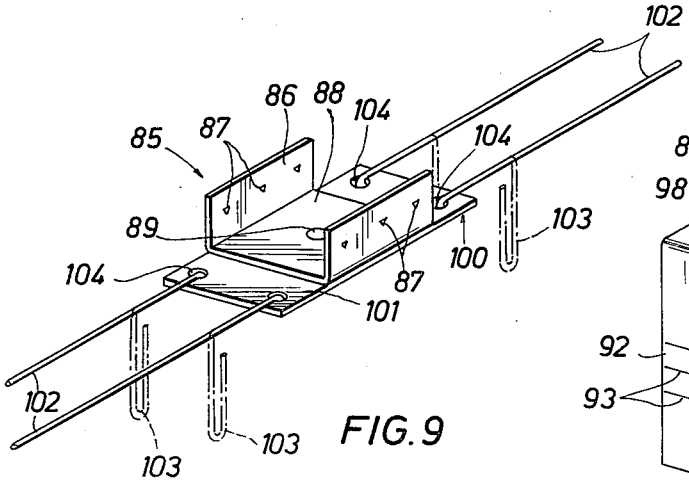
FIG. 9
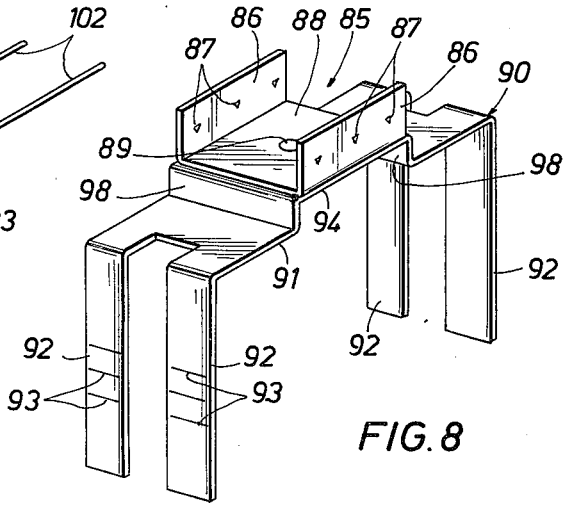
FIG. 8

METHOD AND APPARATUS FOR RIGIDLY INTERCONNECTED CEILING AND WALL CONSTRUCTION

RELATED PATENT APPLICATIONS

This application is a continuation-in-part of U.S. Pat. Application Ser. No. 464,192, filed Apr. 25, 1974, now abandoned.

BACKGROUND OF THE INVENTION

This invention relates to a construction hanger for rigidly interconnecting a building wall of dry-wall construction to a suspended ceiling for forming a rigid integral ceiling-wall constriction. More particularly, the hanger engages and securely holds a structural wall channel member in a closely spaced relation to a ceiling inverted tee support member.

It has been common practice in commercial building construction to utilize a suspended ceiling and walls of a dry-wall construction. The ceiling is constructed of a plurality of inverted tee support members suspended to form a grid system for supporting ceiling tiles. Utilizing a suspended ceiling, however, presents a problem of how to support the building walls, particularly upper support for the walls. It has been common practice to utilize a structural channel member to which wall panels could be attached as the upper wall structural member and to attach the channel member to the ceiling inverted tee support members. Attachment of the channel member to the tee support member involved aligning the channel member with the tee support member and then drilling holes in the two aligned members for connection with screws, or by utilizing self tapping screws and a power screwdriver to attach the two members together. The projecting screw portion above the tee member often had to be clipped in order that the ceiling tiles could be inserted. To install a concealed ceiling, in which the tee support members are concealed by the ceiling tiles, a spacer block, commonly of plywood, had to be cut and inserted between the tee support member and the channel member before attachment of the two members. Holes then had to be cut in the ceiling tiles to accommodate the spacer blocks. This procedure was laborious and time-consuming, and often the channel members and tee support members were not properly aligned when attached, which increased problems of constructing the wall later.

Other prior art includes special clips for suspending ceiling inverted tee support members such as those described in U.S. Pat. Nos. 3,708,941 and 3,784,177, and a furring hanger disclosed in U.S. Pat. No. 2,631,809. Other patents directed to wall construction include U.S. Pat. Nos. 2,017,911 and 3,295,284, but the construction disclosed therein utilizes apparatus and clips for suspending runners for supporting ceiling tiles or for attaching runners to wall joists for supporting wall panels. These patents do not disclose a rigidly interconnected, suspended tile ceiling and building dry-wall structure utilizing a construction hanger for interconnecting inverted tee support members of a suspended ceiling wall structural channel members.

Other prior art includes special hangers for suspending lighting fixtures from ceiling inverted tee support members as disclosed in U.S. Pat. Nos. 3,589,660, 3,780,973 and 3,797,791. These hangers are special purpose hangers and do not involve wall or ceiling construction.

These hangers are generally constructed to provide for ease of attachment by one skilled in lighting fixture installation and allow for manipulation along the tee support member subsequent to installation rather than a fixed installation. Further, these hangers generally provide only a rather loose support for the lighting fixtures since a rigid combination is not required.

Accordingly, one primary feature of the present invention is to provide a construction hanger for rigidly interconnecting a suspended ceiling and building wall.

Another feature of the present invention is to provide a hanger for rigidly interconnecting a ceiling inverted tee support member and a structural wall channel member in constructing an interconnected ceiling and wall.

Yet another feature of the present invention is to provide a hanger for rigidly interconnecting a ceiling inverted tee support member and a structural wall channel member that is inexpensive and easy to install.

Still another feature of the present invention is to provide a hanger for rigidly interconnecting a ceiling inverted tee support member and a structural wall channel member that is self-attaching without the need for screw fasteners or the like.

Another feature of the present invention is to provide a hanger for rigidly interconnecting a ceiling inverted tee support member and a structural wall channel member that may be utilized with a variety of wall channel member designs.

Yet another feature of the present invention is to provide a hanger for rigidly interconnecting a ceiling inverted tee support member and a structural wall channel member that may be installed by hand utilizing a pair of pliers, thus eliminating the need for electrically driven power tools.

SUMMARY OF THE INVENTION

The present invention remedies the problems of the prior art by providing a rigidly interconnected dry-wall and ceiling structure for buildings comprising a plurality of spaced inverted tee support members suspended in the building, a plurality of ceiling tiles for placement between the tee support members to form a ceiling, a structural wall channel member for defining the upper structural support for a wall, wall panel members attachable to the structural wall channels for forming a wall, and construction hangers attachable to the inverted tee support members and to the structural wall channel members to rigidly interconnect and support the channel member in closely spaced relation to the inverted tee support member. In one preferred embodiment, the construction hanger has a generally U-shaped configuration having a body member and legs extending from opposing ends of the body member, the depending legs spaced to receive the structural channel member and bendable to engage the channel member for supporting and securely gripping the member. The hanger also comprises a gripping means for cooperating with the body member for securely gripping the tee support member. In one preferred embodiment, the gripping means comprises a generally U-shaped member having a flat base and extending integral tabs spaced to receive the tee support member and bendable over the flanges of the tee support member to securely grip the member. The U-shaped member is pivotally attached to the body member of the hanger by a rivet or other ordinary attaching means. Other forms of the gripping means include bendable tabs integrally extending from opposing sides of the body member of the hanger, the tabs being spaced to receive the tee support member, or bendable tabs integrally struck from the body member of the hanger and extending in a spaced relation to receive the tee support member.

In another embodiment, the gripping means comprises a pre-formed spring clamping member have a generally flat base and generally opposed C-shaped spring clamps depending therefrom, a first spring clamp having depending edges which engage one flange of the tee support member to prevent movement along the member and a second spring clamp long enough to engage the other flange of the tee support member with a plurality of teeth near the front edge to prevent movement perpendicular to the member. The pre-formed spring clamping member may be pivotally attached to the body member of the hanger.

In another preferred embodiment, the body member of the hanger has a central raised section carrying the gripping means for spacing the tee support member a predetermined interval from the channel member to accommodate slotted ceiling tiles for concealing the tee support members.

BRIEF DESCRIPTION OF THE DRAWINGS

In order that the manner in which the above-recited advantages and features of the invention are attained can be understood in detail, a more particular description of the invention may be had by reference to specific embodiments thereof which are illustrated in the appended drawings, which drawings form a part of this specification. It is to be noted, however, that the appended drawings illustrate only typical embodiments of the invention and therefore are not to be considered limiting of its scope, for the invention may admit to further equally effective embodiments.

In the drawings:

FIG. 1 is a perspective view of a construction hanger according to this invention shown interconnecting an inverted tee support member and a wall structural channel member.

FIG. 8 is a perspective view of a third embodiment of a generally U-shaped hanger according to this invention.

FIG. 9 is a perspective view of a fourth embodiment of the construction hanger according to this invention.

FIG. 13 is a partial vertical cross-sectional view of a third form of ceiling and wall structure utilizing the construction hanger according to one embodiment of this invention.

FIG. 14 is a partial vertical cross-sectional view of a fourth form of ceiling and wall structure utilizing the construction hanger according to one embodiment of this invention.

DETAILED DESCRIPTION OF THE PREFERRED EMBODIMENTS

Figure 2:
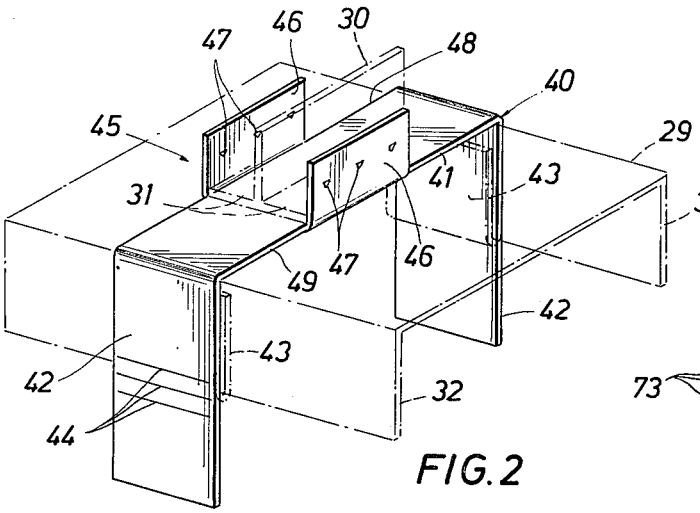
FIG. 2 is a perspective view of a generally U-shaped embodiment of the hanger according to this invention illustrating one form of the tee support member gripping means.

Referring now to FIG. 1, one embodiment of the construction hanger according to this invention is illustrated. Construction hanger 20 is shown comprising a central body member 21 having legs 22 extending from opposing ends of body member 21. Legs 22 are constructed of a bendable material, such as galvanized sheet metal, and may have a plurality of scored lines 33 for aiding in sharply bending the legs 22 to engage a structural channel member 29. The legs 22 may be bent along the first scored line 33 so as to form depending legs spaced to receive the structural channel member 29 having depending flanges 32. The legs 22 may further be bendable along selected scoring lines 33, depending on the length of channel flanges 32, to form a pair of spaced U-shaped hanger members 23 for engaging the flanges 32 of channel member 29 to support and grip the member. Scoring 33 may be located to acommodate various widths of channel members 29 or various lengths of flanges 32. Attached to body member 21 is a gripping means 24 for securely gripping a ceiling tee support member 30. In FIG. 1, the gripping means comprises an embodiment having a generally U-shaped member having a base 25 and upwardly extending opposed tabs 26. Tabs 26 are spaced to receive the inverted tee support member 30 and bendable over the flanges 31 of the tee support member 30 to securely grip member 30. To aid in gripping the flanges 31 of tee support member 30, tabs 26 have die-stamped teeth 27 for engaging the surface of flanges 31. Gripping means 24 is pivotally attached to body member 21 of hanger 20 by means of a rivet 28 or other conventional attaching means.

In the embodiment shown in FIG. 1, the gripping means 24 may be pivoted with relation to the body member 21 of hanger 20, thereby allowing a variable positional relationship between structural channel member 29, forming the upper structural support for a building wall, and the inverted tee support member 30 defining the ceiling grid for supporting ceiling tiles to form the building ceiling. The hanger may be constructed by any suitable yieldable material that may be bent over the tee support member flanges and bent to receive and engage the structural channel member. The legs 22 of hanger 20 may be bent by hand to a generally U-shaped configuration and then bent by hand to engage the flanges 32 of channel member 29. Only a pair of pliers is then needed to securely bend tabs 26 over the flanges 31 of tee support member 30 and to tighten the engagement of legs 22 with the channel support member.

Referring now to FIG. 2, a second embodiment of the construction hanger 40 is shown. In FIG. 2, construction hanger 40 comprises a body member 41 and extending legs 42 pre-formed into a generally U-shaped configuration, with depending legs 42 spaced to receive a structural channel member 29, having depending flanges 32. Legs 42 have scoring lines 44 for allowing legs 42 to be sharply bent along a selected scoring line 44, depending on the length of flanges 32 of channel member 29, to form a pair of spaced hanger members 43 that engage the depending flanges 32 of channel member 29. In this embodiment, one form of a gripping means 45 is shown. This form of the gripping means embodies bendable tabs 46 integrally extending from opposing sides 48 and 49 of body member 41. The tabs 46 are spaced to receive the inverted tee support member 30 and inwardly bendable over the flanges 31 of the tee support member 30 to securely grip the member 30. As can be seen, the tabs 46 form spaced gripping members for gripping tee support member 30 with tabs 46 bendable to a position generally parallel to the body member 41. Tabs 46 have projecting teeth 47 for aiding in gripping the surfaces of flagnes 31 of tee support member 30. As may be seen, the embodiment shown in FIG. 2 would permit a structural channel member 29 to be supported in a transverse relationship to tee support member 30.

Figure 3:
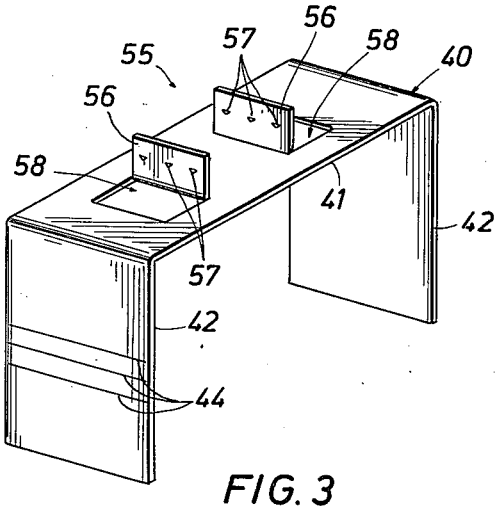
FIG. 3 is a perspective view of a generally U-shaped embodiment of the hanger according to this invention illustrating a second form of the tee support member gripping means.
Figure 4:
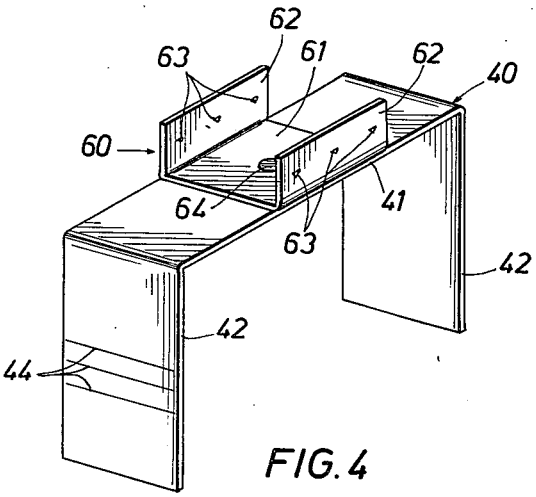
FIG. 4 is a perspective view of a generally U-shaped embodiment of the hanger according to this invention illustrating a third form of the tee support member gripping means.

FIGS. 3 and 4 illustrate further embodiments of the U-shaped configuration of construction hanger 40 shown in FIG. 2, but differ in that they illustrate differing embodiments of gripping means for securing the construction hanger to a ceiling tee support member. In FIG. 3, the gripping means 55 comprises bendable tabs 56 integrally struck from the body member 41 and positioned to extend upwardly from the surface of the body member 41 leaving openings 58 in body member 41. Tabs 56, carrying projecting teeth 57, are spaced to receive an inverted tee support member and are inwardly bendable over the flanges of the tee support member to a position generally parallel to body member 41 for securely gripping the member. Utilizing this embodiment of the gripping means, a structural support channel may be supported in parallel relationship to the ceiling tee support members. In FIG. 4, the gripping means 60 is of a generally U-shaped configuration, having a base 61 and upwardly extending opposed tabs 62. The tabs 62 have projecting teeth 63 for the purposes hereinbefore mentioned. Gripping means 61 is attached to body member 41 by means of a rivet or other conventional attaching means for allowing gripping means 60 to pivotally move with relation to body member 41. Tabs 62 are bendable to a position generally parallel to a plane passing through the base section 61. It will be apparent that utilizing the embodiment of the gripping means shown in FIG. 4, a structural channel member may be positioned in any positional relationship with respect to ceiling inverted tee support members.

Figure 5:
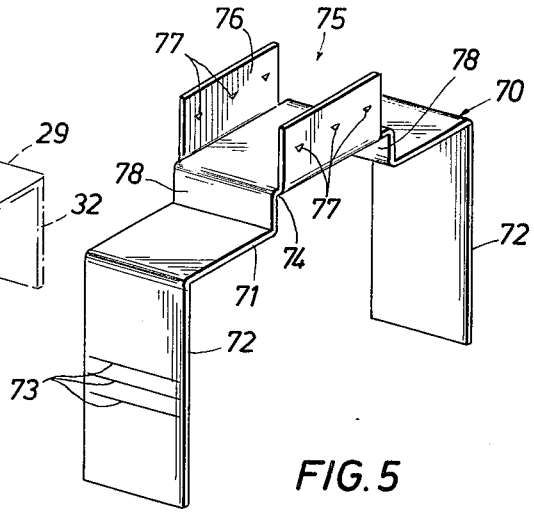
FIG. 5 is a perspective view of a second embodiment of a generally U-shaped hanger according to this invention, having one form of the tee support member gripping means.
Figure 6:
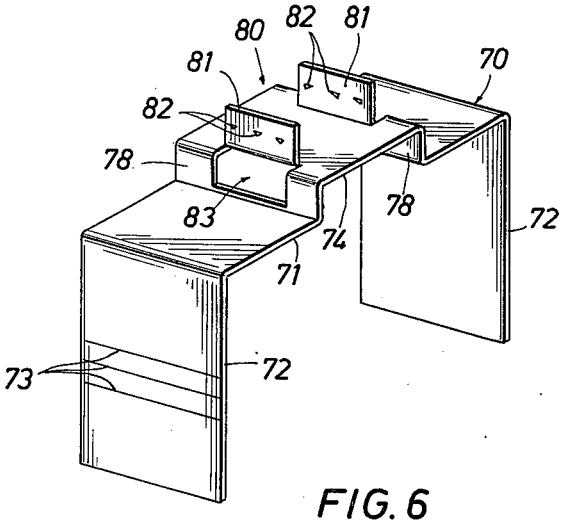
FIG. 6 is a perspective view of a second embodiment of a generally U-shaped hanger according to this invention having a third form of the tee support member gripping means.
Figure 7:
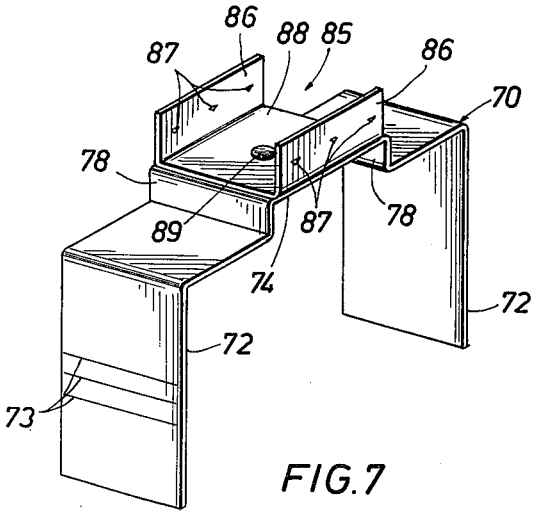
FIG. 7 is a prespective view of a second embodiment of a generally u-shaped hangar according to this invention having another form of the tee support gripping member.

Referring now to FIGS. 5, 6 and 7, other embodiments of the construction hanger according to this invention are shown. The construction hanger 70 shown in FIG. 5 has a pre-formed generally U-shaped configuration, as does construction hanger 40 shown in FIG. 2, with a principal difference being that construction hanger 70 includes a raised section 74 centrally located of body member 71 and connected thereto by means of shoulders 78. The reasons for raised section 74 will be hereinafter further discussed. Construction hanger 70 includes body member 71 and the above mentioned raised section 74, and has depending legs 72 having scoring lines 73 for aiding in bending legs 72 to engage a structural channel member as hereinabove described for previous embodiments. The gripping means 75 utilized with hanger 70, as shown in FIG. 5, comprises bendable tabs 76 integrally extending from opposing sides of the raised section 74, the tabs 76 being spaced to receive an inverted tee support member and inwardly bendable over the flanges of the inverted tee support member for securely gripping the member, as hereinabove described for the embodiment shown in FIG. 2. Tabs 76 have projecting teeth 77 to aid in gripping the flanges to the tee support member.

In FIG. 6, the gripping means 80 comprises extending tabs 81 integrally struck from the raised section 74, leaving openings 83. The tabs 81 are provided with teeth 82 for the purposes hereinabove previously described. The tabs 81 are bendable to a position substantially parallel to the surface of the raised section 74 for forming spaced gripping members for securely gripping the flanges of the inverted tee support member, as hereinabove described for a similar embodiment shown in FIG. 3.

In FIG. 7, a construction hanger 70 having another embodimennt of the gripping means 85 is shown. Gripping means 85 comprises a generally U-shaped member having a flat base 88 and extending spaced bendable tabs 86 and having projecting teeth 87 for purposes hereinabove described. The U-shaped member 85 may be pivotally attached to raised section 74 of hanger 70 by means of a rivet 89 or other pivotal attaching means. The tabs 86 are bendable to a position substantially parallel to a plane passing through the base 88 for forming spaced gripping members for securely gripping the flanges of an inverted tee support member, as hereinabove discussed for a similar embodiment shown in FIG. 4.

FIG. 8 illustrates yet another embodiment of a construction hanger 90 according to this invention. Construction hanger 90 has a body member 91 with a central raised section 94 and connected thereto by means of shoulders 98. Hanger 90 has a plurality of legs 92 extending from body member 91 and formed into a generally U-shaped configuration, similar to the embodiment of the hanger 70 shown in FIG. 7. Legs 92 have scoring lines 93 to facilitate bending of the legs, as hereinabove described for previous embodiments. Construction hanger 90 has the indentical gripping means 85 above described with respect to embodiment 70 shown in FIG. 7, and will not be further described with regard to this embodiment. Of course, other embodiments of the hanger shown in FIGS. 1–7 may utilize the plurality of legs as shown in FIG. 8.

FIG. 9 is yet another embodiment of this invention showing a construction hanger 100 having a body member 101 and extending legs 102 formed of heavy, stiff wire. Wire legs 102 may be attached in any conventional manner, such as by looping through slots 104 of body member 101. Stiff wire legs 102 may be bent into a depending configuration and further bent to form hanger members 103 for engaging and supporting a structural channel member, as hereinabove described for previous embodiments. The gripping means 85 of construction hanger 100 is identical to the gripping means 85 shown for previous embodiments 70 and 90, as illustrated in FIGS. 7 and 8, and will not be further described.

Figure 15:
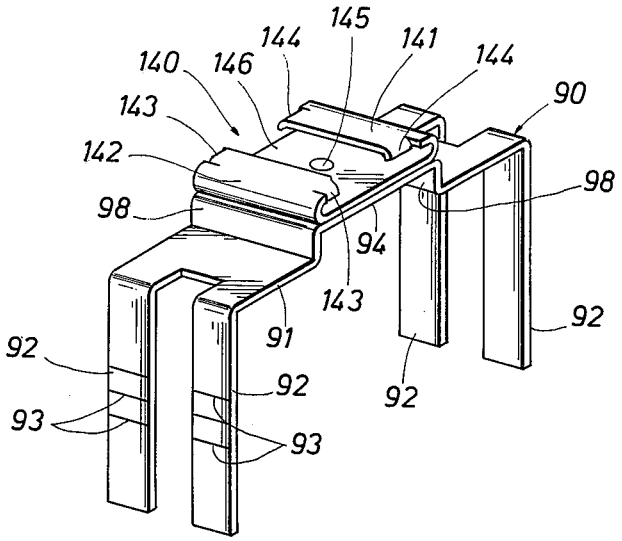
FIG. 15 is a perspective view of a third embodiment of a generally U-shaped hanger according to this invention having a fourth form of the tee support member gripping means.
Figure 16:
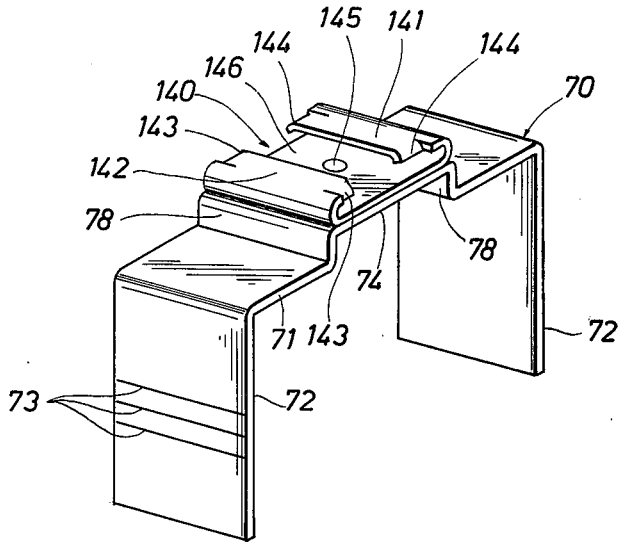
FIG. 16 is a perspective view of a second embodiment of a generally U-shaped hanger according to this invention having a fourth form of the tee support member gripping means.

FIGS. 15 and 16 show another embodiment of the tee support member gripping means 140 on body member 91 and body member 71 respectively. Gripping means 140 is a preformed spring clamping member having a flat base 146 and a generally C-shaped first spring clamp 141 and second spring clamp 142 opposing the first spring clamp 141 and depending from flat base 146. The spring clamping member 140 may be pivotally attached to raised section 94 of hanger 90 of raised section 74 of hanger 70 by means of a rivet 145 or other ordinary attachment means. The first spring clamp 141 further comprises depending edges 144 along the upper portion for engaging the top surface of one flange of an inverted tee support member and prevent movement along the tee member. The second spring clamp 142 is formed to a length which allows the gripping means 140 to be snapped onto the other flange of the inverted tee support member and further comprises a plurality of teeth 143 which act to prevent movement after installation. The first spring clamp 141 is formed to a length to fully engage one flange of the inverted tee support manner whereas the second spring clamp 142 is formed to a shorter length to snap over the edge of the other flange when the first spring clamp 141 is fully engaged.

Figure 10:
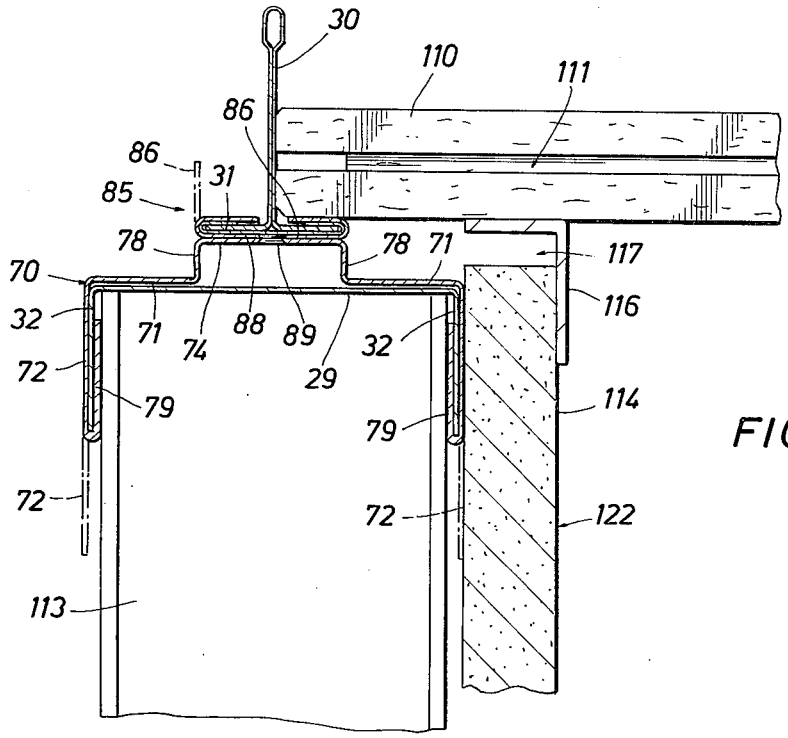
FIG. 10 is a partial vertical cross-sectional view of a building ceiling and wall structure illustrating the use of the construction hanger according to one embodiment of this invention.

Referring now to FIGS. 7, 10, 11 and 12, a rigidly interconnected dry-wall and ceiling structure for buildings utilizing the construction hanger according to this invention is shown. The embodiment of the hanger shown in FIG. 7 is illustrated in the construction drawings of FIGS. 10 – 12, but obviously other embodiments may be utilized as well. In FIG. 10, a ceiling inverted tee support member 30 is suspended in the building by conventional hanger means (not shown) for supporting ceiling tiles 110. Hanger 70 is shown with gripping means 85 having tabs 86 bent to engage flanges 31 of tee support member 30, as hereinbefore described. The tee support member 30 rests on base 88 of the gripping means U-shaped member 85, and member 85 may be pivotally positioned by means of rivet 89 as hereinabove described to position member 30 and wall support member 29 in a desired relative position. As previously described, raised section 74 is positioned centrally of body member 71 and attached thereto by means of shoulders 78 to space the inverted tee support member 30 from the structural wall channel member 29 by a predetermined interval for purposes to be hereinafter further described. Legs 72 of hanger 70 are inwardly bent, as hereinabove described, to form a pair of spaced U-shaped hanger members 79 for engaging depending flanges 32 of channel member 29 for rigidly interconnecting annd supporting the structural wall channel member 29 in a closely spaced relation to the inverted tee support member 30.

Structural wall channel member 29 is a structural member for defining the upper structural support for a vertical wall 122. Wall studs 113 are spaced the length of member 29 for providing structural strength to the wall 122. A plurality of wall panel members 114, which may conveniently be sheet rock or other wall construction materials, are then attachable to channel member 29 utilizing conventional attaching means (not shown) for forming the vertical building wall 122. Wall panel 114 is typically trimmed so as not to project appreciably above the plane of body member 71 of hanger 70 and provides a space 117 between the top edge of wall panel member 114 and ceiling tile 110. This space may conveniently be closed to provide a finished wall-ceiling joint by means of an L-shaped trim member 116. In the manner above described, a rigidly interconnected dry wall and ceiling structure for a building may be constructed in which the upper structural wall channel member 29 is rigidly interconnected and supported in closely spaced relation to the inverted tee support members 30.

Figure 11:
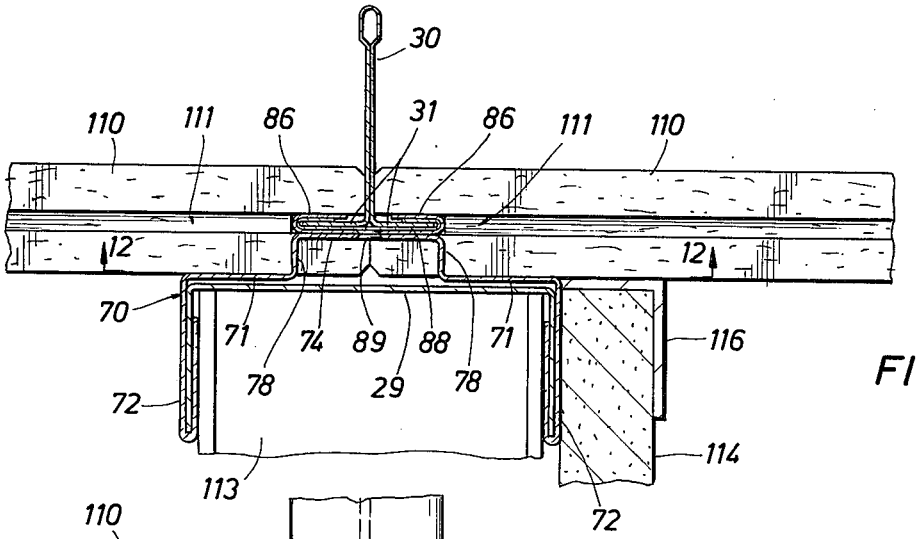
FIG. 11 is a partial vertical cross-sectional view of a second form of a ceiling and wall structure utilizing the construction hanger according to one embodiment of this invention.
Figure 12:
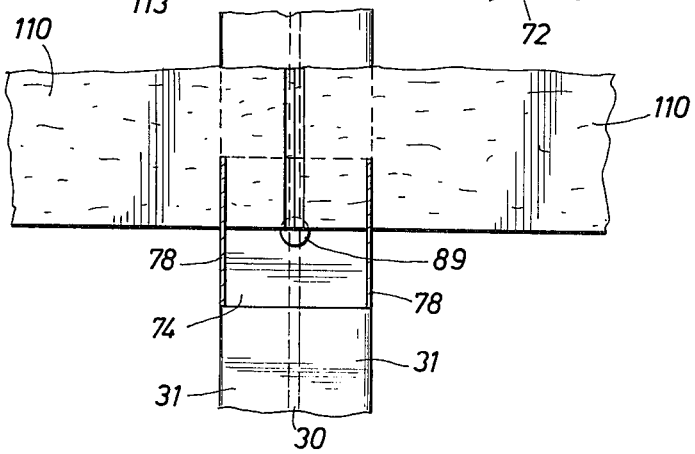
FIG. 12 is a partial horizontal cross-sectional view of the construction hanger taken along lines 12—12 of FIG. 11.

In FIG. 11, the identical wall construction is shown as was previously shown in FIG. 10, but the advantages of the embodiments of the construction hanger according to this invention having the reaised central section are illustrated. In FIG. 11, the wall construction and the utilization of construction hanger 70 is identical to that previously described with regard to FIG. 10. However, FIG. 11 illustrates a different ceiling construction by which ceiling tiles 110 may be supported by inverted tee support members 30 by means of slots 111 cut into the periphery of the tiles 110 engaging flanges 31 of tee support member 30. The edges of adjacent tiles 110 meet to conceal the tee support member 30 for forming a "concealed ceiling." The slot 111 is wide enough to accept the thickness of flanges 31, raised section 74, base 88 and tabs 86 of hanger 70, and, as may be further seen in FIG. 12, the ceiling tile may be forced against shoulder 78 to cut the soft material of the ceiling tile 110 to force ceiling tile 110 over a portion of shoulder 78 without having to taken time to cut out the corner of the ceiling tile 110. Accordingly, tile 110 may quickly and easily be inserted in position with only minor repairable damage.

In FIG. 13, yet another rigidly interconnected dry wall and ceiling structure is shown, utilizing another embodiment of structural channel member 118. Structural channel member 118 has exterior depending flanges 119 and interior depending flanges 120. Wall studs 113 are spaced along channel member 118 between the interior depending flanges 120, and wall panel members 114 are inserted between depending flanges 119 and 120 of channel member 118 to form a vertical wall. Channel member 118 may be provided with pairs of opposed slots 121 spaced along its length for accepting the depending legs 72 of hanger 70. Depending legs 72 are bent into a U-shaped hanger member 79 configuration, similar to the configuration shown in FIG. 10, for supporting the structural wall channel member 118. Gripping means 85,pivotally interconnected to raised section 74 by means of a rivet or toher conventional means, has extending tabs 86 for gripping inverted tee support member 30, as hereinabove described. In this way, yet another embodiment of a rigidly interconnected dry wall and ceiling stucture for buildings may be constructed, utilizing a construction hanger according to this invention for rigidly interconnecting and supporting structural wall channel member 118 in closely spaced relation to the inverted tee support member 30.

FIG. 14 illustrates another embodiment of a rigidly interconnected dry wall and ceiling structure for building in which yet another embodiment of a structural wall channel member 125 is provided. Structural wall channel member 125 has depending flanges 126, and is provided with a pair of spaced slots 128 spaced along its length to facilitate the insertion of the depending legs 72 of a hanger according to this invention, shown in FIG. 14 as being construction hanger 70. The legs 72 of construction hanger 70 may be bent upwardly to engage the channel member 125 for supporting and gripping the member in closely spaced relation to the inverted tee support member 30. Gripping means 85 is identical to the gripping means illustrated in FIGS. 7, 10 – 12 and 13, and functions in the same manner to securely grip inverted tee support member 30, as previously described. In FIG. 14, the channel member 125 may be utilized in connection with a dry-wall construction using pre-formed wall panels comprising a plurality of layers of wall panel members 114 supported by bracing material 127.

Figure 17:
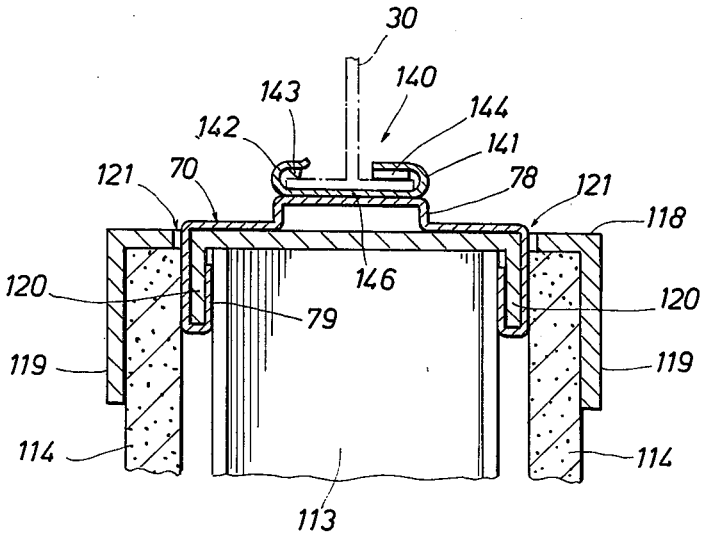
FIG. 17 is a partial vertical cross-sectional view of a form of ceiling and wall structure utilizing a pre-formed construction hanger according to one embodiment of this invention.

In FIG. 17, the identical wall construction is shown as was previously shown in FIG. 13, but the embodiment of the construction hanger according to this invention having a preformed spring clamping member as gripping means 140. The first spring clamp 141 extends almost the width of a flange on an inverted tee support member with extending edges 144 engaging the top of the flange to prevent movement along the tee support member once the hanger 70 is snapped onto the flange at a desired location. The second spring clamp 142 extends over the edge of a flange where extending tabs 143 on the front corners engage a flange of the tee support to prevent movement perpendicular to the tee support member. Gripping means 140 is engaged with a tee support member by moving first spring clamp 141 into engagement with a flange of the tee support member and then snapping the second spring clamp 142 over the edge of another flange of the member. Once gripping means 141 is located on an inverted tee support member, the extending edges 144 and extending tabs 143 act to prevent movement of the gripping means 140 relative to the tee support member. Gripping means 140 may also be utilized in wall construction as shown in FIGS. 10, 11 and 13 and 14.

Based on the foregoing, a method of ridigly interconnecting a dry-wall and ceiling in a building construction is shown, comprising the steps of suspending a plurality of spaced inverted tee support members, placing a plurality of ceiling tiles between the inverted tee support members to form a ceiling, spacing a structural wall channel for defining the upper structural support for a vertical wall in closely spaced relation to the inverted tee support members, attaching a plurality of spaced hangers to the flanges of the inverted tee support members and to the structural wall channel member to rigidly interconnect the structural wall channel member to the inverted tee support members, and attaching a plurality of wall panel members to the structural wall channel for forming a vertical building wall.

Numerous variations and modifications may obviously be made in the structure herein described without departing from the present invention. Accordingly, it should be clearly understood that the forms of the invention herein described and shown in the figures of the accompanying drawings are illustrative only and are not intended to limit the scope of the invention.

What is claimed is:

1. A rigidly interconnected dry wall and ceiling structure for buildings, comprising:

a plurality of spaced inverted tee support members supported in said building, a plurality of ceiling tiles adapted for supporting placement between said inverted tee support members for forming a building ceiling, a structural wall channel member having an inverted U-shape for defining the upper structural support for a vertical wall, a plurality of spaced hangers attachable to the flanges of said inverted tee support members and to said structural wall channel for rigidly interconnecting and supporting said structural wall channel member in closely spaced relation to said inverted tee support members, said hanger comprising a body member having legs extending from opposing ends thereof forming a generally inverted U-shape, said legs formed of a bendable material for forming depending legs spaced to receive at least a portion of said structural channel member therebetween and further bendable for supporting and securely gripping said member, and said body member further having a centrally located raised section for spacing said structural channel member from said inverted tee support member and gripping means located on said raised section of said body member, and a plurality of wall panel members attachable to said structure wall channels for forming said vertical building wall.

2. The structure described in claim 1, wherein said gripping means comprises a pair of inwardly extending tabs spaced to receive said inverted tee support member and formed of a bendable material for bending over the flanges of said inverted tee support member and securely gripping said member.

3. The structure described in claim 1, wherein said gripping means comprises a generally U-shaped member having a flat base and extending bendable tabs spaced to receive said inverted tee support member and inwardly bendable over the flanges of said inverted tee support member for securely gripping said member, and means for pivotally mounting said U-shaped member to said raised section of said body.

4. The structure described in claim 1, wherein said gripping means comprises a pre-formed spring clamping member having a generally flat base and extending C-shaped spring clamps spaced to receive and securely grip the flanges of said inverted tee support member.

5. As a subcombination, a dry-wall and ceiling construction hanger attachable to an inverted tee ceiling support member, comprising a body member having a central body portion and legs extending from opposing ends thereof, said body portion having an integral centrally located raised section spaced above said body portion by a pair of shoulders and said legs formed of a bendable material for forming spaced depending legs and inwardly bendable for forming at least a pair of spaced hanger members of selected length, and gripping means located on said centrally located raised section of body member.

6. The subcombination described in claim 5, wherein said gripping means comprises a pair of spaced upwardly extending tabs formed of a bendable material for inward bending over the flanges of said inverted tee support member and securely gripping said member.

7. The subcombination described in claim 5, wherein said gripping means comprises a generally U-shaped member having a flat base and extending bendable tabs, said tabs inwardly bendable over the flanges of said inverted tee support member, and means for pivotally mounting said U-shaped member to said raised section of said body member.

8. The subcombination described in claim 5, wherein said gripping means comprises a pre-formed spring clamping member having a generally flat base and extending C-shaped spring clamps spaced to receive and securely grip the flanges of said inverted tee support member.

9. The subcombination described in claim 8, wherein said C-shaped spring clamps comprise a first spring clamp having a pair of depending edges which engage a flange of said inverted tee support member to prevent movement along said member, and a second spring clamp depending from said body member of said gripping means opposite said first spring clamp and having a plurality of teeth which snap over the other flange of said tee support member to prevent movement of said hanger.

10. The subcombination described in claim 8, wherein said gripping means further comprises means for pivotally mounting said pre-formed spring clamping member to said raised section of said body member.

11. As a subcombination, a dry-wall and ceiling construction hanger comprising a first generally U-shaped member having a central body portion and legs extending from opposing ends thereof, said central body portion having an integral raised section spaced above said body portion by a pair of shoulders and said legs forming spaced depending legs upwardly bendable for forming at least a pair of spaced hanger members a second generally U-shaped member having a base and extending spaced bendable tabs, said tabs bendable to a position substantially parallel to a plane passing through said base for forming at least a pair of spaced gripping members, and means for pivotally mounting said second U-shaped member to said body member.

12. As a subcombination a dry-wall and ceiling construction hanger comprising a generally U-shaped member having a central body portion and legs extending from opposing ends thereof, said central body portion having an integral raised section spaced above said body portion by a pair of shoulders and said legs forming spaced depending legs upwardly bendable for forming at least a pair of spaced hanger members, a pre-formed spring clamping member having a generally flat base and at least a pair of generally opposed C-shaped spring clamps extending from said base, means for pivotally mounting said spring clamping member to said body member.

13. In an interconnected dry-wall and ceiling structure for buildings including a plurality of spaced inverted tee support members suspended in said building for supporting ceiling tiles therebetween to form a ceiling and a structural wall channel member attachable to said inverted tee support members for defining the upper structural support for a plurality of wall panels attachable to said structural wall channel member for forming a vertical building wall, the combination thereof with said inverted tee support members and said structural wall channel member of a hanger comprising a first generally U-shaped member having a central body portion with legs extending from opposing ends thereof, said central body portion having an integral raised section spaced above said body portion by a pair of shoulders and said legs formed of a bendable material for forming depending legs spaced to receive said structural channel member and further bendable to a selected length to engage said structural channel member for supporting and securely gripping said member, and gripping means located on said raised section of said body member.

14. The structure described in claim 13, wherein said gripping means comprises a pair of upwardly extending tabs spaced to receive said inverted tee support member and formed of a bendable material for bending over the flanges of said inverted tee support member and securely gripping said member.

15. The structure described in claim 13 wherein said gripping means comprises a second generally U-shaped member having a flat base and extending bendable tabs spaced to receive said inverted tee support member and inwardly bendable over the flanges of said inverted tee support member for securely gripping said member, and means for pivotally mounting said U-shaped member to said raised section of said body member.

16. The structure described in claim 13, wherein said gripping means comprises a pre-formed spring clamping member having a generally flat base and extending C-shaped spring clamps spaced to receive and securely grip the flanges of said inverted tee support member.

17. The structure described in claim 16, wherein said C-shaped spring clamps comprise a first spring clamp having depending edges which engage a flange of said inverted tee support member to prevent movement along said member and a second spring clamp depending from said body member of said gripping means opposite said first spring clamp, and having a plurality of teeth which snap over a flange of said tee support member to prevent movement of said hanger after installation, means for pivotally mounting said pre-formed spring clamp member to said raised section of said body member.

18. In an interconnected dry-wall and ceiling structure for buildings including a plurality of spaced inverted tee support members suspended in said building for supporting ceiling tiles therebetween to form a ceiling and a structural wall channel member attachable to said inverted tee support members for defining the upper structural support for a plurality of wall panels attachable to said first structural wall channel member for forming a vertical building wall, the combination thereof with said inverted tee support members and said first structural wall channel member of a hanger comprising a first generally U-shaped member having a central body portion and legs extending from opposing ends thereof, said central body portion having an integral raised section spaced above said body section by a pair of shoulders and said legs forming spaced depending legs for receiving said structural channel member and bendable to engage said structural channel member for supporting and gripping said member, a second generally U-shaped member having a flat base and extending bendable tabs spaced to receive said inverted tee support member and inwardly bendable over the flanges of said inverted tee support member for securely gripping said member, and means for pivotally mounting said U-shaped member to said raised section of said body portion of said U-shaped member.

19. In an interconnected dry-wall and ceiling structure for buildings including a plurality of spaced inverted tee support members suspended in said building for supporting ceiling tiles therebetween to form a ceiling and a structural wall channel member attachable to said inverted tee support members for defining the upper structural support for a plurality of wall panels attachable to said first structural wall channel member for forming a vertical building wall, the combination thereof with said inverted tee support members and said first structural wall channel member of a hanger comprising a generally U-shaped member having a central body portion and legs extending from opposing ends thereof, said central body portion having an integral raised section spaced above said body portion by a pair of shoulders and said legs forming spaced depending legs for receiving said structural channel member and bendable to engage said structural channel member for supporting and gripping said member, a pre-formed spring clamping member having a generally flat base and extending C-shaped spring clamps spaced to receive and securely grip the flanges of said inverted tee support member, and means for pivotally mounting said spring clamping member to said raised section of said body portion of said U-shaped member.

* * * * *